US006223934B1

(12) United States Patent
Shoenfeld

(10) Patent No.: US 6,223,934 B1
(45) Date of Patent: May 1, 2001

(54) SCRUB DISPENSING CABINET

(75) Inventor: Norman A. Shoenfeld, Livingston, NJ (US)

(73) Assignee: S&S X-Ray Products, Inc., Brooklyn, NY (US)

( * ) Notice: Subject to any disclaimer, the term of this patent is extended or adjusted under 35 U.S.C. 154(b) by 0 days.

(21) Appl. No.: 09/483,961

(22) Filed: Jan. 18, 2000

(51) Int. Cl.[7] ..... B65H 5/28

(52) U.S. Cl. ..... 221/71; 221/130; 221/197; 221/287

(58) Field of Search ..... 221/71, 70, 72, 221/25, 130, 287, 197

(56) References Cited

U.S. PATENT DOCUMENTS

| | | | | |
|---|---|---|---|---|
| 3,616,965 | | 11/1971 | Bendl | 221/84 |
| 3,991,907 | | 11/1976 | Kull | 221/84 |
| 4,812,985 | | 3/1989 | Hambrick et al. | 364/478 |
| 4,839,875 | | 6/1989 | Kuriyama et al. | 369/14 |
| 5,102,008 | * | 4/1992 | Kaufman et al. | 221/25 |
| 5,385,265 | | 1/1995 | Schlamp | 221/7 |
| 5,438,523 | | 8/1995 | Humm et al. | 364/479 |
| 5,638,985 | | 6/1997 | Fitzgerald et al. | 221/125 |
| 5,732,401 | | 3/1998 | Conway | 705/29 |

* cited by examiner

*Primary Examiner*—David H. Bollinger
(74) *Attorney, Agent, or Firm*—Bernhard P. Molldrem, Jr.

(57) ABSTRACT

A scrubs dispenser cabinet dispenses garment tops and bottoms to customers in a plurality of sizes. A cabinet housing has a dispense port at a convenient location on the front. A pair of reels within the housing have a first web belt wound onto them and the belt has pockets or compartments along its length. These compartments are adapted to be loaded with scrub tops. The belt passes over idlers along a path so that the compartments on the first belt align with the dispense port as the belt unwinds from one reel and winds onto the other. Another pair of reels has a second web belt, the second belt similarly having compartments, here adapted to be loaded with said scrub bottoms. The second belt also moves on a path that aligns the compartments with said dispense port as the belt unwinds from one of the reels and winds onto the other. When a customer selects scrubs of a preferred size, the reels turn to move the belt to the nearest scrubs compartment of the selected size, which will not result in overloading either of the associated reels. The dispenser cabinet can be loaded according to the expected usage patterns to minimize the waiting or process time when a given scrub size is selected. The scrub tops and bottoms can be dispensed independently.

20 Claims, 3 Drawing Sheets

SCRUB DISPENSING CABINET

BACKGROUND OF THE INVENTION

This invention relates to devices and techniques for vending or dispensing articles, and is especially directed to a dispensing cabinet and technique for efficiently dispensing garments, i.e., hospital scrubs. The invention is more specifically concerned with a belt-type dispenser in which articles of various sizes, such as hospital scrub tops and bottoms, can be dispensed to satisfy customer needs. The technique of this invention concerns loading the hospital scrubs into the machine and dispensing the scrubs in a suitable sequence to minimize customer waiting time and to maximize the dispenser's capacity.

A surgical scrub dispenser is a dispensing machine that controls the accessibility of the scrubs, i.e., the green shirts and pants that are worn in hospital operating rooms. These garments are issued to hospital personnel and serve to prevent contamination between patients and health workers. There are also associated scrub return devices, into which the customer can return the soiled garments. Each of these may be tied to a network in the hospital laundry facility to keep track of the numbers and sizes of scrub tops and bottoms checked out to each of the hospital personnel, and to alert laundry personnel when a dispenser is running out of garments or if the machine becomes jammed or inoperative for some reason.

Hospitals and clinics usually provide scrubs to surgeons, nurses and attendants at no cost to them. For purposes of this discussion, the surgeons, physicians, nurses, visitors, and others who obtain scrubs can be considered "customers." Each customer is permitted to have some limited number of scrubs outstanding at any one time, and is expected to return the scrubs to the return facility when they have been worn or if they become soiled. Traditionally, hospitals would leave a stack of clean scrubs in the changing rooms for the physicians, nurses and staff. These would have a tendency to disappear during the day, and would not be available later in the day or in the evening. This led physicians to hoard scrubs in their locker so they would not be caught without scrubs in the evening. This hoarding has led to shortages, which led to greater hoarding. Another method was to assign a hospital attendant with the task of issuing scrubs to customers, but with no real control or accounting for how many scrubs were dispensed. Soiled scrubs were returned by leaving them in laundry carts in the changing rooms, or simply leaving them lying on the floor of the changing room. However, even with this limited level of control, because the hospital must be open at all times, and because fresh scrubs may be needed in any and all the various surgery facilities within the hospital, staffing the laundry attendant position has become a burden on the hospital. For these reasons, there has been much interest recently in automating the issuance and return of hospital garments. In addition, there remains the need to account for the numbers of scrub tops and bottoms issued to each customer, as well as the need to maintain data concerning scrub usage for purposes of re-stocking.

One example of a vending or dispensing device for hospital garments of this type is described in Fitzgerald et al. U.S. Pat. No. 5,638,985. That device attempts to accommodate the fact that hospital garments are cloth and not all the same size by placing clean garments in each of various slot-like compartments, and then employing a system of doors to permit customer access to the compartments to obtain the garments. The scrub dispensing system of that patent has 120 fixed and separate compartments, and each is to contain a top and a bottom folded together. This makes it impossible to obtain just the top or just the bottom, if only one garment becomes soiled and needs to be replaced after a procedure. If it is desired to provide a mixed-size scrub suit where the top and bottom are of different sizes, the laundry attendant would have to load this unusual combination specifically into a slot in the machine. Consequently, mixed sizing of scrubs is difficult logistically and is a major problem to satisfy. Also, to access the slots, there is a system of eight outer doors that each extend across the front of the machine from top to bottom, and a system of vertical extrusions behind them that are movable to provide access to a single slot at a time. Thus for some customers, it is necessary to reach high to an upper slot, or to bend down to a low slot to obtain scrubs. The unit has a card reader or badge reader associated with it to permit customer access, and also has a keypad for entry of customer data, and can be connected to a laundry network to provide data about customer activity and scrub dispenser status.

The system of the above-noted Fitzgerald et al. patent has an associated scrubs return cabinet, which is described in U.S. Pat. Nos. 5,713,270 and 5,829,349.

It was desired to create a scrubs dispense cabinet with at least the additional advantages of increased capacity, simplicity of design, dispensing of the scrubs at a convenient level so that the customer does not have to stretch or bend to an extreme high or low position It was also desired to be able to dispense scrub tops and bottoms separately. The latter feature would permit the customer to obtain scrubs that are not both the same size, e.g., a large bottom and medium top, or to obtain only a top or only a bottom, if that is what is needed, so as to conserve the scrubs supply.

It is also desired to create a dispensing system and technique that can be used with articles other than hospital garments, such as towels which may be dispensed at a hotel swim pool or fitness facility, or for dispensing other items of various types or sizes, and which are capable of being carried on a web or belt.

OBJECTS AND SUMMARY OF THE INVENTION

Accordingly, it is an object of the present invention to provide a dispensing cabinet or station, and a technique for loading the dispensing cabinet and dispensing articles to customers, that avoid the drawbacks of the prior art.

It is another object to provide a cabinet of increased capacity over the dispensing cabinets now available, and which dispenses hospital scrubs to customers conveniently and with a minimum of wait time.

It is a further object to provide a dispensing cabinet and technique that permits the customer to obtain hospital garments of a desired size mix to fit the customer's need, such as top and bottom of the same size, top and bottom of different sizes, top alone, or bottom alone.

It is still another object to provide a hospital garment dispensing cabinet that has a control system programmed with a suitable algorithm to keep track of the number of garments of each size that have been withdrawn from the cabinet, how many garments and of what size have been issued to which customers, and to access the next selected garment of any particular size in the shortest amount of time.

An improved garment return facility is the subject of a separate patent application by the same inventor.

In accordance with an aspect of the present invention, a dispensing cabinet for dispensing articles comprises a cabinet housing. There is a small door or dispense port through which one or the articles, i.e. a scrub top or scrub bottom, or both, can be dispensed to a customer. This port can be at a position about 36 to 40 inches above the floor for the comfort and convenience of the customer. A first reel and a second reel are disposed within the housing and a dispensing web belt is wound onto the first and second reels. Along the length of this belt there are pockets or similar compartments, and the compartments are adapted to be loaded with the scrub tops or bottoms. The belt follows a path between the reels such that the compartments on the belt align with the dispense port as the belt unwinds from one of the reels and winds onto the other. A controlled drive mechanism for turning said reels to move the belt past the dispense port. A control mechanism coupled to the drive mechanism controls the turning of the reels, and selects one of the compartments on the belt and moves the belt to align the selected compartment with the dispense port.

In one possible alternative embodiment, the first and second reels and the belt are situated in a cassette which can be removed from the cabinet and can be loaded at the laundry facility or at another station remote from the dispensing cabinet.

In a preferred arrangement, the hospital garment dispenser is adapted for dispensing scrub tops and bottoms, each in a plurality of sizes, i.e., small, medium, large, and extra-large. As aforesaid, a cabinet housing is configured with a dispense port through which the tops and bottoms in respective desired sizes can be dispensed to a customer. In this case, a first reel and a second reel within the cabinet housing have an associated first web belt wound onto them, with the first belt carrying compartments thereon at intervals or locations over its length. The compartments are adapted to be loaded with garment tops. A third reel and a fourth reel within the cabinet have an associated second web belt wound onto them, with the second belt carrying compartments at intervals or locations over its length. These compartments are adapted to be loaded with garment bottoms. The drive mechanism turns these reels to move either or both belts past the dispense port. The control mechanism controls the turning of said reels to select one of the compartments of one or both belts and to move one or both belts to align such selected compartment(s) with the dispense port. This permits the customer to select any size combination of scrub top and bottom, and also permits the customer to select only a top or only a bottom, as appropriate. The tops are distributed by size in the compartments in the first belt according to a predetermined distribution scheme, and the bottoms are distributed by size in the compartments in the second belt according to a predetermined distribution scheme, so as to permit the dispenser to access quickly any selected size of scrub that a customer may make, and without overloading either reel. After the dispenser is set up to start dispensing scrubs, the same is preferably operative to dispense first from compartments at the middle portion of each belt.

In a preferred surgical scrub suit dispenser of this invention, the scrub suits, i.e., either the tops or the bottoms, are stored in a multi-compartmentalized plastic or Tyvek belt, that runs between left and right reels. There are two belts in the dispenser, i.e., one for the tops and one for the bottoms or pants. The tops and bottoms can be dispensed independently, or the user can individually specify the size of the top and the size of the bottoms or pants. Both are then dispensed through a single door or port located at the center of the front of the dispenser machine.

To operate this dispensing machine efficiently, an algorithm is employed for loading the scrubs in an efficient order to maximize capacity of the dispenser and to minimize the wait time for dispensing any given size scrub suit. The algorithm controlling the loading and unloading of the dispenser also allows the dispenser reels to hold more scrubs than the capacity of a single reel alone, by preventing too many scrubs from being wound up onto either of the two reels. For example, in one possible embodiment each reel can hold a belt containing 80 scrubs, and the belt is permitted to travel between the two reels. Unless a mechanism is employed to limit the amount of loaded belt that can be wound up onto the reels, the maximum capacity of the two reels combined would be only 80 scrubs. However, by keeping track of the compartment positions where scrubs have already been dispensed, and by controlling the drive mechanism to prevent loading more than 80 scrubs onto either reel at any one time, it is possible to increase the capacity significantly. For instance, each reel could potentially hold 70 scrubs at the same time, and another 10 scrubs could initially be on the part of the belt that extends between the reels, for a maximum of 150. The controlling software dispenses the scrubs at first from the middle portion of the belts and then gradually moves to compartments located farther from the center of the belt. The loading of the belt at the laundry is also computer controlled using this algorithm to direct the compartment location for each garment item within the dispenser.

One possible approach to the loading of the belts is to divide each belt into multiple sections, e.g., for a belt capacity of 150 garments, there could be 10 sections of 15 compartments each, or 15 sections of 10 compartments each. Each section could be similarly loaded with a mix of scrub sizes in the proper ratios based on the average number of scrub sizes dispensed for a given location and a given expected workload.

Another approach is to record the order of removal of scrub sizes from a previous day and use that data to determine the load pattern. For example the standard removal order on a Monday could be used in determining the loading of the scrub dispenser on Sunday night for use the next day. For most hospitals, the size distribution would be day-of-week specific, because different operative services use the surgery or operating rooms on different days, and it may be that one type of surgery, e.g., orthopaedics, may require on-average larger scrubs than another procedure, e.g., ENT. The demographics of the surgical staffing may also affect the size order of dispensing of the scrubs, and this can affect the optimal loading pattern. For example, if nurses and technicians who arrive at the operating room earlier use smaller sizes than the surgeons who arrive later in the day, then the data would dictate that a number of the smaller sizes scrubs be concentrated at one location on the belt. This avoids requiring longer belt distances to be traversed to retrieve the smaller sizes, which would otherwise be at more scattered locations along the belt. In these circumstances, the belt unloading order would need to be specified. For example, in the case of a 150-capacity belt and 80-capacity reels, the center of the belt would be unloaded first, i.e., from locations 70 to 80 out of the 150 locations, and a the small sizes would be concentrated at locations in these locations or in adjacent sections. After the central compartments have been accessed, i.e., if most of the garments have been dispensed between locations 40 and 110, then the machine can access the compartment locations closer to the ends without overloading either reel. Eventually, it is possible to access all the garment compartments.

In the case that removal order for a given day is used to determine load order, the load protocol can place the first expected dispenses at the center of the belt. For example, for a belt with a capacity of 150, and where the Monday scrub selection order from the previous week is used, the load order can be generally as follows: 1st scrub dispensed previous Monday—position 76; 2d scrub dispensed—position 77; 3d scrub dispensed—position 78; 4th scrub dispensed—position 79; * * * 75th scrub dispensed—position 150; 76th scrub dispensed—position 1; 77th scrub dispensed—position 2; * * *. Of course, when dispensing, the system would still search for the closest available scrub in the selected size, regardless how the belt was loaded.

When loading the belt according to this approach, at times scrubs may still be in compartments in the belt because they were not dispensed, and are left over in the belt from one day to the next. In that case, if a location is occupied the loading would then go to the next available location after the occupied location. If this left over scrub was a different size from the size that is supposed to be placed there, then the next scrub of that size is skipped to maintain the proper ratio of scrub sizes on the belt.

When unloading, the controller (which can be on-board or can be remoted at the laundry facility) keeps track of how many and what size scrubs have been removed, and which scrub locations remain full. These data are then used to calculate the closest available location for each scrub size, and also calculate whether it is safe to travel to a given location without overloading the belt reels.

The controller calculates which scrub in a given size is the least travel distance from the current location, and commands the drive mechanism to go to that location, if possible without overloading the reels, to minimize dispensing time. If that location is going to result in an overload, the controller selects a location in the other direction, even if somewhat farther to travel. The controller may also calculate which size is most likely to be selected next, based on demographics, time of day, and other factors, and automatically go to a location in anticipation of the next customer. This determination may take into account the number of selections in each available scrub size that have already been made.

In the dispenser of this invention, all the scrub suits are dispensed from the middle center of the unit, so it is unnecessary for the customer to reach high or low to retrieve the scrub suit.

Access to the unit may be controlled centrally, i.e., from the laundry facility. At the dispenser, customer access is obtained e.g., by inputting name and ID number, either on a keypad or by means of a barcode scanner, magstipe scanner, interrogation-response proximity scanner, or other badge or card scan technique. The customer identity is checked against the central database, which includes the sizes of scrub suits usually worn, the maximum number of scrubs allowed to this customer, and the number of scrubs already checked out to this customer. The customer can override the unit and choose a different size scrub suit from the sizes recorded in the data base. This may occur if the customer needs a scrub outfit for a visitor to the operating room.

The system keeps track of the status of each of the dispensing cabinets, and flags an operator or attendant when a dispensing cabinet is approaching empty and needs to be refilled, or if the machine is jammed or overloaded. As aforesaid, another option is for the reels and belts to be fitted into a cassette that can be pre-loaded and quickly interchanged with an empty or partly-filled cassette in the dispensing cabinet. It is also possible for the belt to be pre-loaded, and exchanged for the empty belt with the reels and idler rollers being permanently mounted in the dispenser.

Also, as mentioned before, a dispensing machine incorporating the same principles can be used for dispensing other articles than hospital scrubs. For example, this type of device may be used to control access to towels in hotels and health clubs, with guests or members using their hotel key-card or member ID card to gain access to the towels. This would provide convenient towel access and control for swimming pools or work-out facilities. The dispensing machine could be used for other articles as well that are capable of being dispensed on a belt system.

The database system in the central system computer features demographics data about authorized users or customers, including a) user name, b) ID number, c) preferred size(s), d) allowable quantity outstanding, e) access cutoff date (useful for medical students, residents, others with temporary access), f) automatic mailing list function including: f-1) record of time and date each scrub removed and when returned, f-2) if there are more than one scrubs over the permitted number outstanding for over one week, then automatically generating and sending a reminder letter, f-3) if there are more than one scrubs over the number permitted outstanding for more than three weeks, send a "final notice", and f-4) if there are more scrubs than the number permitted for over one month, generate a bill (or alternatively debit a credit card account or deposit account). The database also keeps a dispensing order history, specific to the day of the week, starting at the time the machine is traditionally loaded by the laundry facility. The system can also flag an operator or attendant when a) the dispenser is empty or near empty, b) the associated scrubs return unit is full, c) the machine is unable to dispense certain scrub sizes due to reel overload constraints, d) machine jamming, or e) machine malfunction, such as loss of network interconnectivity.

There can be more than two belts and two pairs of reels, if appropriate. In some applications, only a single belt and a single pair of reels may be needed. Also, the compartments need not be pockets on the belt, but may be straps or other means for holding the articles in place on the belt, e.g., snaps or Velcro. Also, in embodiments other than those depicted here, the reels may be mounted one above the other, or one behind the other in the cabinet.

As aforesaid, the associated scrubs return mechanism is the subject of a separate invention, and that is disclosed in U.S. patent application Ser. No. 09/495,685, filed Feb. 1, 2000.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
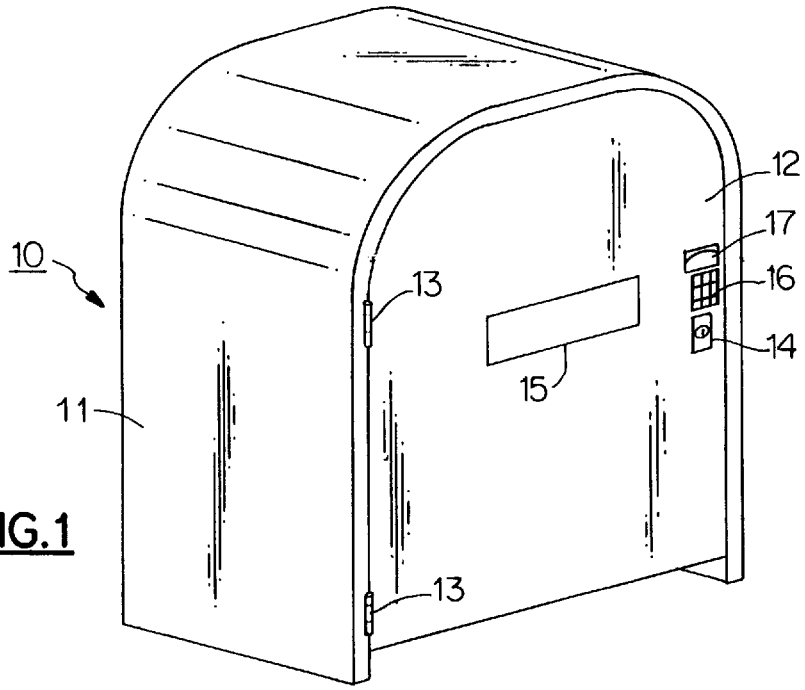
FIG. 1 is a perspective view of a hospital scrubs dispensing station, according to one preferred embodiment of the invention.
Figure 2:
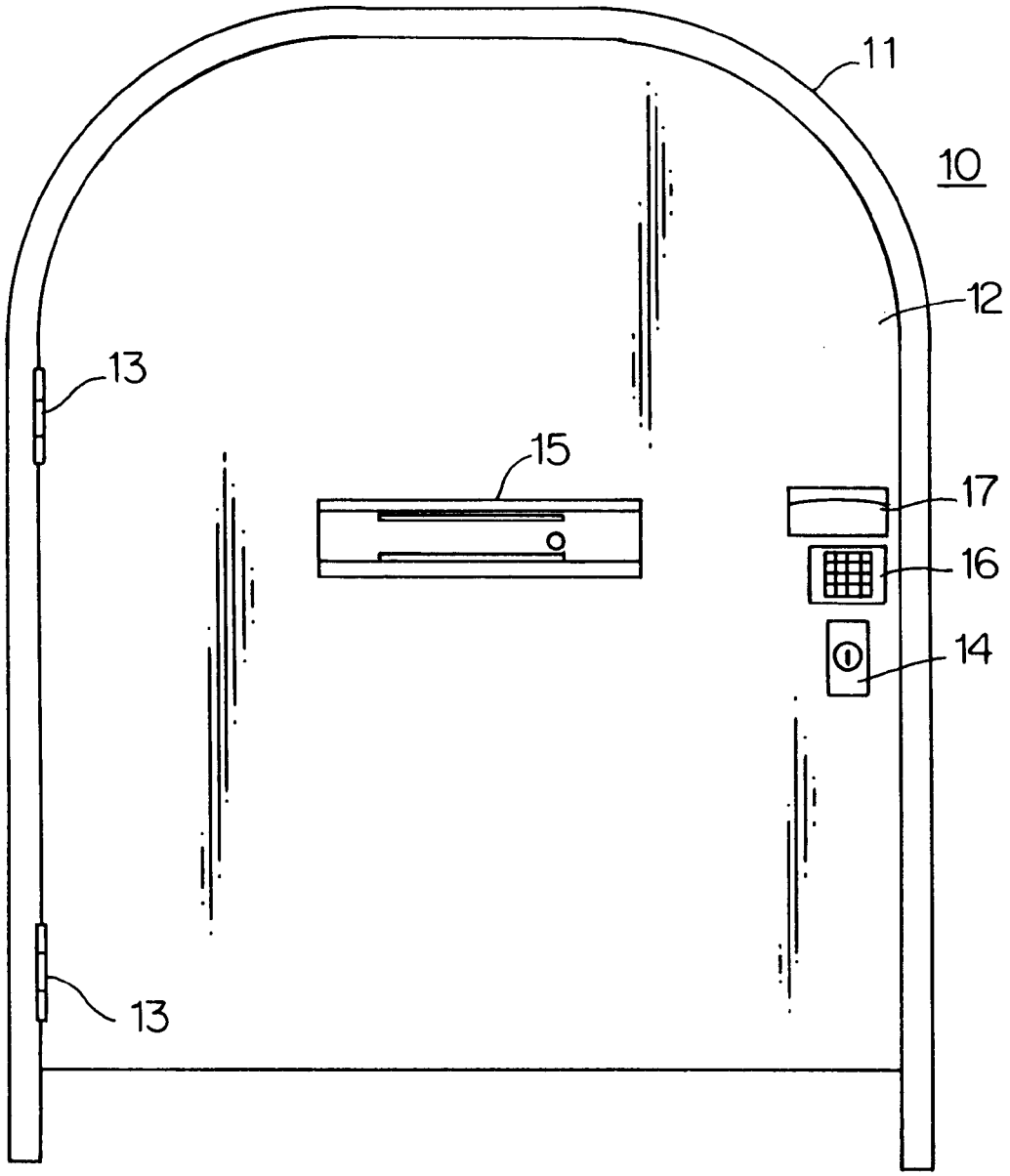
FIG. 2 is a front elevation of this embodiment.

With reference to the Drawing, and initially to FIGS. 1 and 2, a hospital scrubs dispensing cabinet 10 is configured to dispense scrub tops and scrub bottoms to customers, i.e., doctors and nurses, in a variety of sizes such as small, medium, large, and extra-large. The cabinet has a main enclosure 11 formed of a top, back, bottom and side walls, and a front door 12 mounted on hinges 13 onto the enclosure 11. There is a lock 14, positioned at the right side of the door 12 that permits the door 12 to be opened by laundry personnel for loading, clearing problems, and general maintenance. At a center position of the front door 12 is a dispense port 15, with one or more small doors that open to permit a customer to remove the selected top and bottom of a scrub suit. A keypad 16 on the door permits customer entry of customer identity, PINs or access codes, and size selection. There may also be a display feature here, which is not shown in this detail. Above the keypad may be a card reader or badge reader, here a card-swipe mechanism 17 for reading either a bar code on the customer badge or ID card, or reading a magnetic stripe on the card or badge. Other customer identification mechanisms are available and could be used, such as an interrogator that sends an interrogation signal for a short distance in front of the cabinet, and then waits for an electronic response from the customer card or badge. The unit need not have the curved upper corners, as shown here, but may be rectangular, for example.

Figure 3:
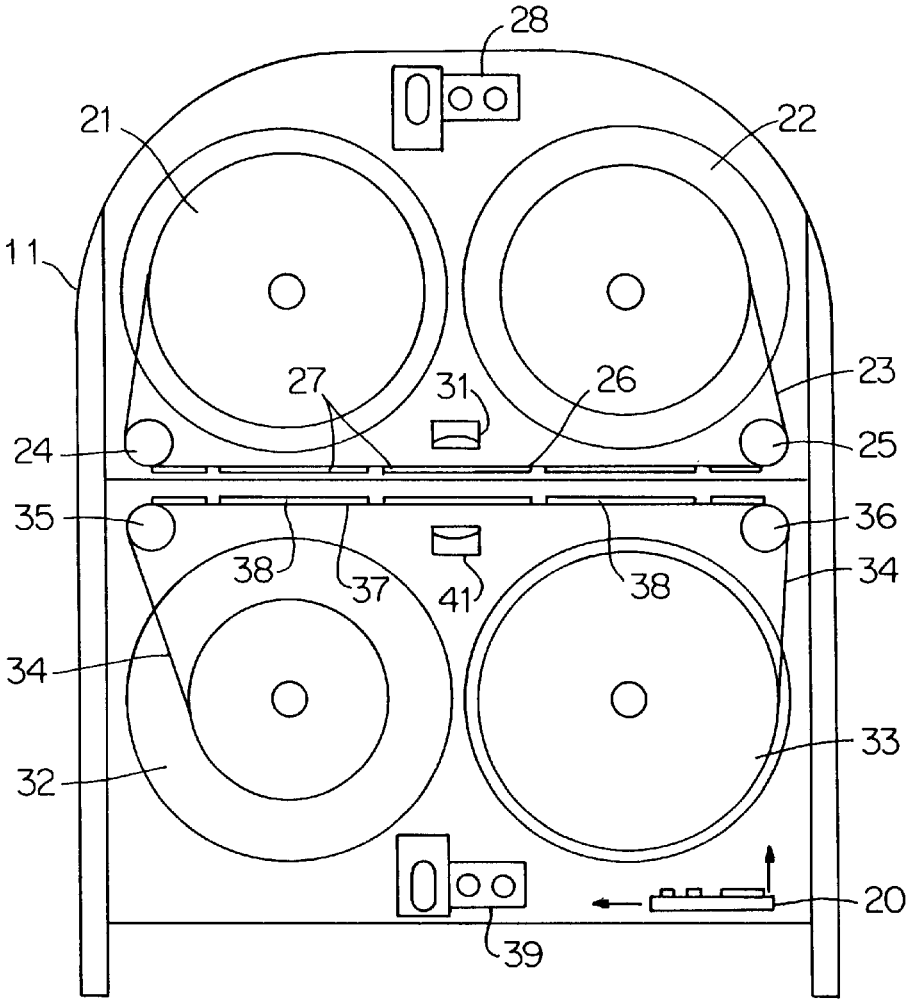
FIG. 3 is a front elevation of this embodiment, showing its interior workings.

A microprocessor-based controller board 20, shown in FIG. 3, is coupled via a wiring harness or other connection to input devices, such as the keypad 16 and badge reader 17, and may also be network-connected to a main hospital computer or to a laundry facility system computer.

Figure 4:
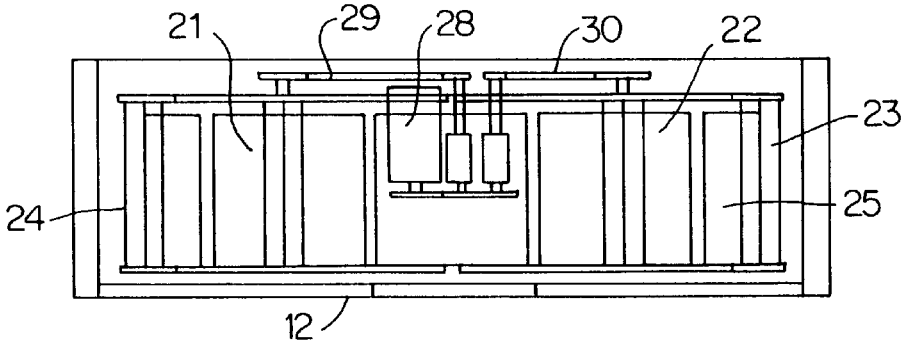
FIG. 4 is top view showing the reel drive mechanism thereof.

As also shown in FIG. 3, there are a left reel 21 and a right reel 22 situated within an upper part of the cabinet 11. A web or belt 23 of plastic, Tyvek, or other suitable material is wound partly about each of the reels 21 and 22, and a middle portion of the belt passes over a pair of idlers 24, 25 that define a pathway 26 that passes the position of the dispense port 15. On one side of the belt 23 there is a series of compartments 27 that each hold a cleaned and folded garment, which in this case is a hospital scrub shirt, or scrub top. This series of compartments 27 extends over the length of the belt. The compartments 27 are initially loaded with scrub top in a predetermined size pattern, to facilitate the distribution and dispensing of scrubs to customers throughout the day. An upper motor drive mechanism 28, including a clutch drive associated with each of the reels 21, 22, is electrically coupled to the controller board 20, and there are drive belts 29, 30 (FIG. 4) extending respectively to the reels 21, 22. A sensor or detector 31 is shown here positioned adjacent a back side of the belt 23, and is operative to pick up coded indicia on the belt. These may be mechanical, magnetic, ferrous or optical indicia. The detector is also coupled to the controller board 20, and assists the latter in keeping track of the positions of the compartments 27 on the belt 23 relative to the position of the dispenser port 15. The position data are also important for preventing overloading of either of the reels 21, 22. Other sensors, not shown, may be employed to detect whether a garment is present in the compartment at the dispense port, or to detect if a customer has failed to remove a selected garment.

For dispensing the scrub bottoms or pants, there is a second left reel 32 and right reel 33, which carry a second web or belt 34 which is similar in design to the belt 23. This belt 34 passes between the reels 32, 33 and over a pair of idlers 35, 36 to determine a path for a middle portion 37 of the belt past the position of the dispense port 15. As with the upper belt, this belt 34 has a series of compartments 38, i.e., pockets, over its length, and these compartments 38 are adapted to be loaded with cleaned and folded scrub bottoms or pants. A motor and drive mechanism 39 is provided at the lower part of the cabinet 11 for driving the pair or reels 32 and 33, and this mechanism 39 is also coupled to the controller board 20. A sensor or detector 41 is positioned adjacent the back of the lower belt 34 to read the position of the compartments 38 on the lower belt relative to the dispense port 15. Instead of the single-motor belt drives 28, 29, the unit may employ pairs of motors with chain drives going to gears on the reels.

In this embodiment, the cabinet has an overall height of about 76 inches, and a width (left to right) of about 60 inches. The cabinet depth (front to back) is about 19 to 20 inches. This configuration provides a relatively small footprint so that the cabinet 10 occupies a minimum of hospital floor space. The dispense port or dispense door 15 is situated at a height of about 36 inches to 40 inches above the floor, which is a convenient height for doctors, nurses, attendants, or other customers. All the selected tops and bottoms are delivered to the customers at this height, so no one has to reach or stoop or bend to pick up his or her hospital scrub suit.

Figure 5:
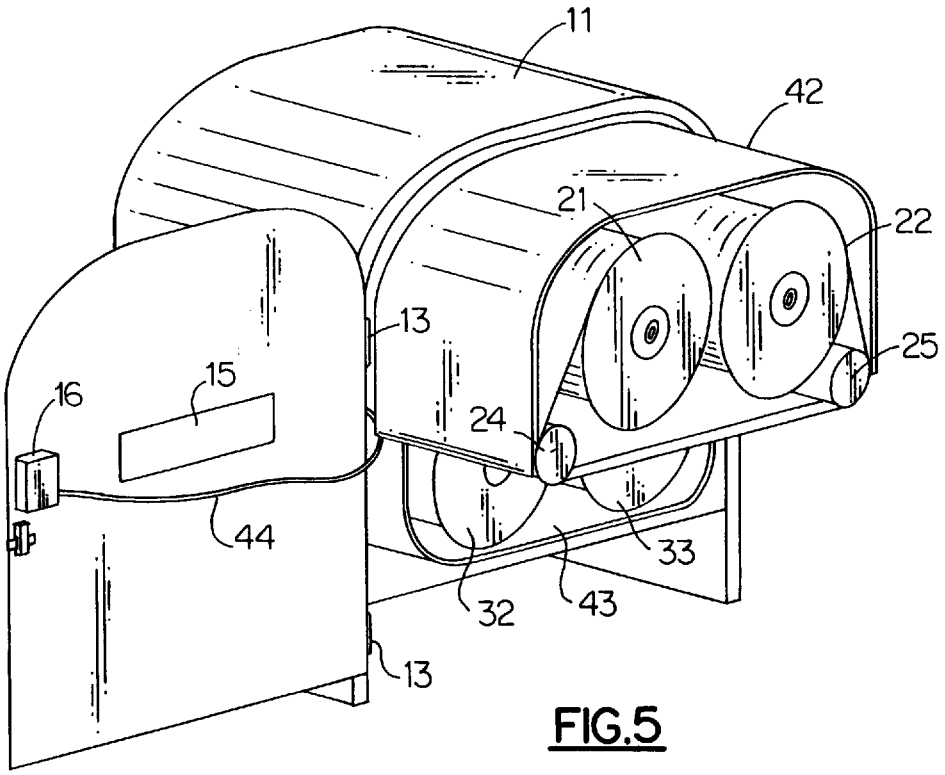
FIG. 5 is a perspective view of another embodiment featuring a cassette load option.

An alternative arrangement shown in FIG. 5, is similar but employs a system of removable cassettes 42 and 43. That is, in this embodiment the upper reels 21, 22 and belt 23 are mounted in a removable cassette 42, which can be preloaded at the hospital laundry and quickly interchanged at the cabinet 10 in the operating room. The lower reels 32, 33 and lower belt 34 are similarly mounted in the lower cassette 43. Also shown in FIG. 5 is the wiring harness 44 that connects the keypad 16 with the controller board (not visible in this view). The drive mechanisms 29 and 39 can be a permanent part of the cabinet 10 and not part of the cassettes 42, 43.

In other alternative arrangements, the cabinet can be configured with their reels side-by-side but with vertical axes, or one above the other on horizontal axes. In other embodiments the reels could be positioned one behind the other.

A key feature in this design is an algorithm for loading scrubs in the most efficient order to maximize capacity of the dispenser cabinet and to minimize the wait time for dispensing any given size of scrub suit. A suitable algorithm for controlling the loading and the unloading or dispensing of the scrubs makes it possible for the belts to hold more scrubs than would be possible otherwise without risking overload of either of the associated reels. In the foregoing embodiments, the belts 23, 34 each have a capacity of 150 tops or bottoms, whereas each reel has a capacity of 80, and will overload if there are more than 80 loaded compartments on the part of the belt wound onto it. Without a suitable control algorithm, the maximum capacity of the entire belt would only be as large as the capacity of one of the reels. However, control software which accounts for the position along the belt where the respective size scrubs are contained, and for the compartment positions that have been emptied, makes it possible for each reel to hold near capacity, e.g., 70 scrubs, at the same time. Together with the scrubs initially loaded onto the middle portions of the belts, each belt may then contain 150 scrubs. Unloading of the scrubs, i.e., dispensing the scrubs in the sizes selected by the customer, positions the scrubs at the dispense port starting at the middle part of the belt to unload first from those compartments. Then after those scrubs have been dispensed, the regions of the belts farther from the center can be accessed without overloading the reels.

One possible approach to loading the belt includes dividing the belt in to successive sections, e.g., 15 sections of 10 compartments per section. In this case, each section would be loaded with a mix of sizes of scrubs in the proper ratios. This would depend upon previous usage patterns, and what usage patterns are expected for that day. For example a section may contain two smalls, three mediums, three larges, and two extra-larges, for a total of ten. Also the size mixes in the sections farther from the middle may vary from those closer, depending upon the times of day when persons of various size requirements are expected to arrive.

Another possible approach involves recording the order in which scrubs of various sizes are withdrawn on a given day, and then using those data to determine the order for loading the scrubs for a successive day. For example, the removal order for a given Monday ( or averaged over a number of Mondays) may be used in determining the loading of the dispensing cabinet on a Sunday night for the next Monday. For most hospitals and clinics, the scrub removal order is day-of-week sensitive, because different operative services may use the operating room on different days. This technique is especially useful where a group of persons who predominantly wear one size arrive at the operating room at one time and a group persons predominantly wearing a different size arrive at another time. For example, if nurses and technicians who enter the operating room earlier wear smaller sizes than the surgeons who arrive later in the day, this information could be used in determining where to concentrate the smaller and larger sizes on the belts, so as to minimize the waiting time for retrieving the desired scrub sizes. In the example mentioned just above, the smaller sizes may be concentrated near one another at the center of the belt, and this segment of the belt would be used in the early morning hours when the nurses arrive. This would eliminate waiting time as compared to what would be encountered with longer belt travel distances to retrieve scattered, less frequently used smaller scrubs.

In this case, for a belt capacity of 150, where the Monday scrub selection order from the previous week for loading the belt, the loading order could be as follows: 1st scrub selected on previous Monday—position 76, 2nd scrub selected—position 77, 3d scrub selected—position 78, . . . 75th scrub selected—position 150, 76th scrub selected, position 1, 77th scrub selected, position 2, etc. However, regardless of loading order, the unloading algorithm will select the nearest occupied compartment position that does not result in the overloading of either of the reels.

Whenever the belt is reloaded, using whatever reload scheme is appropriate, there will be times when undispensed scrubs remain on the belt. That is, clean scrubs will be left over on the belt from one day to the next. In that case, when reaching an occupied compartment, unless the holdover garment was the same size as the one to be loaded, the loading would then go to the next available location. The next scrub of the size previously placed in the belt would be skipped to maintain the proper ratio of sizes.

The belt unloading or dispensing algorithm would have to observe the criteria mentioned previously, of locating the nearest compartments on the belt containing a small, medium, large, or extra-large, and selecting the closest location only if this will not result in overloading either of the two associated reels. If that is going to happen, then the dispensing algorithm will select a near-by location in the other direction on the belt. In the embodiment where there is a 150 capacity belt, the center locations on the belt, i.e., about numbers 60 to 90, would be unloaded first. After this, locations farther from the center, i.e., 30 to 60 and 90 to 120 can be accessed. When there are less than 80 total scrubs remaining on the belt, the entire belt can be accessed. However, in order to minimize waiting time, the algorithm may anticipate what sizes of scrubs are likely to be selected next, and select a location where the travel to those sizes would be minimum. Then the belt would be taken to that position to wait for the next customer selection.

Due to the belt and reel constraints that affect the unloading or dispensing, the algorithm for dispensing determines the dispensing locations on the belt as follows: 1) The system, i.e., either the microprocessor controller board, or the system laundry computer, or both, keeps track of how many and what size scrubs have been removed, and also keeps track of the scrub locations or compartments that remain occupied. These data are then used to determine whether or not it is safe to travel to a given location without overloading a belt reel. 2) The system calculates which scrub location in a given size is the least travel distance from the current location, and directs the dispenser to move the belt to that location. 3) The system may anticipate which size scrub is most likely to be accessed next, based on accumulated customer demographics, day of week, time of day, or other available information. 4) The system may also account for the fact that once a customer of a given size has been issued scrubs, then that customer is no longer likely to require a set of scrubs. That is, for example, once a number of customers have drawn small size scrubs, the probability diminishes, by that amount, that the next size selected is going to be small. 5) Alternatively, the system may select a waiting position where there is the lowest average travel to any size scrub, and move the belt to that waiting position.

During the dispensing operation, knowing the distribution of customers and customer sizes, and knowing what customers have already withdrawn scrubs, permits the dispense algorithm to be optimized using probability of selection, which can be re-calculated after each dispense of a garment. At any given time, the system contains the data of what scrubs remain in the dispenser, and which users are expected to draw garments from the dispenser. With this information, the probability that the next garment will be selected in a given size, e.g., large, can be calculated. The belt can be positioned in a waiting position, awaiting the next customer selection. The scrub size with the highest probability of being selected is positioned at or close to the dispense port, and the scrub with the next highest probability is also close to the dispense port. The scrub size with the lowest probability of selection may be farther from the dispense port. This means the commonly selected sizes, i.e., with the highest probability of being selected, will require smaller travel distances, and low wait time. Only the sizes with a low probability of selection may now require more belt travel, i.e., more process time. The probability for each scrub size would be actively re-calculated as dispensing progresses.

Access to the cabinet may be controlled by a main control unit in the hospital laundry, with the various dispensing cabinets throughout the hospital being linked to it by a network. The customer can access the cabinet using either a keypad input (i.e., name or ID number) or by use of a code on the customer's badge or other access card. The customer ID is then checked against the laundry database, which has personal usage information for each customer, including the sizes of scrubs usually worn, the number checked out to that customer, the maximum number of scrubs authorized, and other data as needed for dispensing of garments. The customer may override the programmed size selection, and choose a different size of top or bottom, or both. This may be necessary to accommodate a visitor to the operating room who does not wear the same size. The customer may also select only a top or only a bottom, for example, to replace a top or bottom that has become soiled or contaminated during a prior surgical procedure. In that case, the customer can input on the keypad that only the scrub top is desired, and no bottom will be dispensed.

The system also keeps track of the number of scrubs remaining on the belt for each of the hospital's dispenser cabinets, and can flag an operator or attendant whenever a dispenser is about to run out of garments. The system can also flag an operator when a machine becomes jammed, or if some other malfunction occurs. The system also flags an operator or attendant if the associated return unit is full or nearly full with returned scrubs, if the dispensing machine is unable to dispense certain sizes because of reel overload constraints, or if there is a loss of network interconnectivity.

The computer system database keeps track of authorized users and customer demographics, as well as size distributions from day to day. For each customer, the data include customer name, ID number, preferred scrub sizes, allowable quantity (e.g., three sets), access cutoff date (in the case of visitors, medical students or residents, or those with temporary access), and data for automatic mailing list for overdue notices and billing for unreturned scrubs.

Also, while the invention has been described in terms of a hospital scrub dispensing arrangement, a dispenser incorporating the principles of this invention could be used for other dispensable items. Similar machines may be used to dispense non-surgical garments, such a clean-room cloaks or lab coats, or for towels in a hotel or health-club environment. In the latter case, the hotel or club guest could access the machine with a membership card or room key card. The machine is ideal for holding such soft foldable items, which may be compressed on the belt when wound onto the reels. However, the dispensing machine could be used for vending or dispensing other items, generally.

While the invention has been described hereinabove with reference to a preferred embodiment, it should be recognized that the invention is not limited to that precise embodiment. Rather, many modification and variations would present themselves to persons skilled in the art without departing from the scope and spirit of this invention, as defined in the appended claims.

I claim:

1. Dispensing cabinet for dispensing articles, comprising a cabinet housing having a dispense port through which one of said articles can be dispensed to a customer; wherein said dispense port comprises a door in a front of the cabinet that opens to permit the customer to remove the article; first and second reels disposed within said housing; a web belt wound onto said first and second reels, said belt including a plurality of compartments carried thereon at intervals over its length, wherein the compartments are adapted to be loaded with said articles; means within said cabinet defining a path for said belt between said reels such that the compartments on said belt align with said dispense port as the belt unwinds from one of the reels and winds onto the other of the reels; drive means for turning said reels to move said belt past said dispense port; and control means coupled to said drive means for controlling the turning of said reels to select one of the compartments of said belt and move the belt to align such selected compartment with said dispense port.

2. Dispensing cabinet according to claim 1 wherein said first and second reels and said belt are situated in a cassette which can be removed from said cabinet so that the compartments can be loaded at a station remote from said cabinet.

3. Dispensing cabinet for dispensing articles, comprising a cabinet housing having a dispense port through which one of said articles can be dispensed to a customer; first and second reels disposed within said housing; a web belt wound onto said first and second reels, said belt including a plurality of compartments carried thereon at intervals over its length, wherein the compartments are adapted to be loaded with said articles; means within said cabinet defining a path for said belt between said reels such that the compartments on said belt align with said dispense port as the belt unwinds from one of the reels and winds onto the other of the reels; drive means for turning said reels to move said belt past said dispense port; and control means coupled to said drive means for controlling the turning of said reels to select one of the compartments of said belt and move the belt to align such selected compartment with said dispense port; wherein when said compartments on said belt have been loaded with said articles, a first end portion of said belt is wound onto said first reel, a second end portion of said belt is wound onto said second reel, and a middle portion thereof extends between the reels, and said control means is operative at commencement of dispensing to select initially a compartment at said middle portion of said belt.

4. Dispensing cabinet for dispensing articles, comprising a cabinet housing having a dispense port through which one of said articles can be dispensed to a customer; first and second reels disposed within said housing; a web belt wound onto said first and second reels, said belt including a plurality of compartments carried thereon at intervals over its length, wherein the compartments are adapted to be loaded with said articles; means within said cabinet defining a path for said belt between said reels such that the compartments on said belt align with said dispense port as the belt unwinds from one of the reels and winds onto the other of the reels; drive means for turning said reels to move said belt past said dispense port; and control means coupled to said drive means for controlling the turning of said reels to select one of the compartments of said belt and move the belt to align such selected compartment with said dispense port; wherein said compartments are adapted to hold soft, pliant articles such that the articles can be compressed as the web belt is wound upon one of said reels.

5. Dispensing cabinet for dispensing articles, comprising a cabinet housing having a dispense port through which one of said articles can be dispensed to a customer; first and second reels disposed within said housing; a web belt wound onto said first and second reels, said belt including a plurality of compartments carried thereon at intervals over its length, wherein the compartments are adapted to be loaded with said articles; means within said cabinet defining a path for said belt between said reels such that the compartments on said belt align with said dispense port as the belt unwinds from one of the reels and winds onto the other of the reels; drive means for turning said reels to move said belt past said dispense port; and control means coupled to said drive means for controlling the turning of said reels to select one of the compartments of said belt and move the belt to align such selected compartment with said dispense port; and wherein said belt carries position-identifying coded indicia thereon to identify the location sequence position for each of said compartments on said belt, and further comprising detecting means sensitive to said coded indicia for identifying the location sequence of the compartment located at said dispensing port.

6. Garment dispenser for dispensing garment tops and bottoms each in a plurality of sizes, comprising a cabinet housing having a dispense port through which the garment tops and bottoms in respective desired sizes can be dispensed to a customer; a first reel and a second reel disposed within said cabinet housing, a first web belt wound onto said first and second reels, said first belt including a plurality of compartments carried thereon at intervals over its length and wherein the compartments are adapted to be loaded with said garment tops; first means within the cabinet housing defining a path for said first belt within said cabinet housing between said first and second reels so that the compartments on said first belt align with said dispense port as the belt unwinds from one of the first and second reels and winds onto the other of the reels; a third reel and a fourth reel disposed within said cabinet housing; a second web belt wound onto said third and fourth reels, said second belt including a plurality of compartments carried at intervals over its length and wherein the compartments are adapted to be loaded with said garment bottoms; second means within the cabinet housing defining a path for said second belt within said cabinet housing between said third and fourth reels so that the compartments on said second belt align with said dispense port as the belt unwinds from one of the third and fourth reels and winds onto the other reel; drive means for turning said reels to move said belts past said dispense port; and control means coupled to said drive means for controlling the turning of said reels to select one of the compartments of one or both of said belts and to move one or both belts to align such selected compartment with said dispense port.

7. Garment dispenser according to claim 6 wherein said tops and said bottoms are each present in three or more sizes, and the tops are distributed by size in the compartments in the first belt according to a predetermined distribution scheme, and the bottoms are distributed by size in the compartments in the second belt according to a predetermined distribution scheme.

8. Garment dispenser according to claim 7, said control means tops being operative to identify for said customer a desired size of at least one of said garment top and said garment bottoms, and to move one or both of said first and second belts to a position at which said at least one of the tops and bottoms of said desired size is positioned at said dispensing port.

9. Garment dispenser according to claim 7 wherein when said compartments on said first and second belts are loaded with said tops and bottoms; a first end portion of the first belt is wound onto said first reel, a second end portion of the first belt is wound onto said second reel, a middle portion of the first belt extends between the first and second reels, a first end portion of the second belt is wound onto said third reel, a second end portion of said second belt is wound onto said fourth reel, and a middle portion of the second belt extends between the third and fourth reels; and said control means is operative at a commencement of dispensing of said tops and bottoms to select initially compartments on said middle portions of said first and second belts.

10. Garment dispenser according to claim 6 wherein said control means includes a keypad to permit said customer to select at least one of a top and bottom in the customer's desired size.

11. Garment dispenser according to claim 6 wherein said control means includes a badge reader.

12. Garment dispenser according to claim 6 wherein said control means includes means for storing customer size information including garment top size and garment bottom size respectively for a plurality of customers.

13. A method of loading hospital scrubs into a scrub dispenser and dispensing the scrubs from the dispenser to customers, in which scrubs of three or more sizes are each carried in a respective compartment on a web belt that has a first end portion wound upon a first reel, a second end portion wound upon a second reel, and a middle portion that extends between said reels and passes a dispense port through which a hospital scrub of a desired size can be removed by a customer; and in which control and drive means are operative to turn the first and second reels controllably to move the belt past said dispense port and halt the belt when a compartment containing a hospital scrub of the desired size is aligned with said dispense port; the method comprising loading the scrubs according to a size distribution scheme into the compartments along the belt; and each time a customer selects a scrub of a given size, moving said belt so that a nearby compartment containing such size scrub is aligned with said port.

14. The method of claim 13 wherein, after each scrub is dispensed, determining a new position of the belt such that the distance along the belt from such position to compartments holding scrubs of each respective size is kept to a short distance for each size of scrub, thus keeping dispense time to a minimum; and moving the belt to said new position.

15. The method of claim 13 wherein each of said reels has a maximum capacity of a predetermined number of said compartments when loaded with said scrubs, and said belt is loaded with a number of scrubs exceeding that predetermined number, but less than the capacity of both said reels.

16. The method of claim 15 wherein said dispensing of the scrubs includes selecting a compartment on said belt containing a scrub of a desired size but which, when the belt with the filled compartments is wound onto the first or second reel to place such selected compartment at the dispensing port, will not exceed the capacity of such reel, and turning said reels to position said selected compartment at said dispensing port.

17. The method of claim 13 wherein the belt is configured into a plurality of sectors with a predetermined number of compartments in each such sector, and wherein said loading includes filling the compartments in each sector according to a predetermined size distribution scheme.

18. The method of claim 13 comprising recording data including the sequence in which the scrubs of the respective sizes are dispensed to customers from the scrub dispenser, and reloading scrubs of the respective sizes into the compartments on said belt according to said recorded data.

19. The method of claim 13 wherein a predetermined number of customers are expected for each of said sizes of scrubs, and the method including computing probabilities of each of said sizes being selected by and dispensed to a subsequent customer, and turning said reels to position said belt such that the distance to a compartment that holds a size scrub most likely to be next selected is kept to a minimum.

20. The method of claim 19 comprising recomputing said probabilities after each dispensing of a scrub to a customer by accounting for the scrub sizes that have already been selected.

* * * * *